US009809424B2

(12) United States Patent
Peacock et al.

(10) Patent No.: US 9,809,424 B2
(45) Date of Patent: Nov. 7, 2017

(54) METHOD AND AN ELEVATOR ARRANGEMENT

(71) Applicants: Mark Peacock, Riihimaki (FI); Yan Zhizhong, Espoo (FI); Johannes De Jong, Jarvenpaa (FI)

(72) Inventors: Mark Peacock, Riihimaki (FI); Yan Zhizhong, Espoo (FI); Johannes De Jong, Jarvenpaa (FI)

(73) Assignee: Kone Corporation, Helsinki (FI)

( * ) Notice: Subject to any disclaimer, the term of this patent is extended or adjusted under 35 U.S.C. 154(b) by 636 days.

(21) Appl. No.: 13/779,091

(22) Filed: Feb. 27, 2013

(65) Prior Publication Data

US 2013/0233655 A1 Sep. 12, 2013

(30) Foreign Application Priority Data

Mar. 6, 2012 (EP) ..... 12158197

(51) Int. Cl.
*B66B 19/00* (2006.01)
*B66B 9/187* (2006.01)
(Continued)

(52) U.S. Cl.
CPC ..... *B66B 20/00* (2013.01); *B66B 9/187* (2013.01); *B66B 19/00* (2013.01); *B66B 11/0045* (2013.01)

(58) Field of Classification Search
CPC ..... B66B 11/0045; B66B 19/00; B66B 9/187
See application file for complete search history.

(56) References Cited

U.S. PATENT DOCUMENTS 5,601,156 A 2/1997 McCarthy et al.
2005/0150728 A1* 7/2005 Van Der Meijden et al. ..... 187/411
(Continued)

FOREIGN PATENT DOCUMENTS

CN 101535165 A 9/2009
CN 102341336 A 2/2012
(Continued)

OTHER PUBLICATIONS

Aug. 7, 2012 International Search Report for EP12158197.9.
Office Action dated for corresponding Chinese Application No. 201310065035.9 dated Jan. 26, 2016.

*Primary Examiner* — William A Rivera
*Assistant Examiner* — Stefan Kruer
(74) *Attorney, Agent, or Firm* — Harness, Dickey & Pierce, P.L.C.

(57) ABSTRACT

A method of constructing an elevator, the elevator including a hoistway, an elevator car, a first movable support structure in the hoistway above the elevator car, for supporting the elevator car with a roping, and a roof structure, separate from the movable support structure, in the hoistway above the support structure, where the elevator car is used for transporting passengers and/or goods, and thereafter the first movable support structure is lifted higher in the hoistway, and thereafter the elevator car is used again for transporting passengers and/or goods. The method includes lifting the roof structure higher in the hoistway so as to make more room below the roof structure, the roof structure being a movable roof structure, and in that the movable roof structure is lifted in the hoistway taking support for the lift from a second movable support structure mounted in the hoistway above the roof structure.

14 Claims, 4 Drawing Sheets

(51) Int. Cl.

| | |
|---|---|
| ***B66B 20/00*** | (2006.01) |
| *B66B 11/08* | (2006.01) |
| *B66B 11/00* | (2006.01) |

(56) References Cited

U.S. PATENT DOCUMENTS

| | | | | |
|---|---|---|---|---|
| 2009/0223751 | A1 | 9/2009 | Peacock | |
| 2010/0068005 | A1 | 3/2010 | Wurth | |
| 2010/0133048 | A1* | 6/2010 | Barneman | 187/414 |
| 2011/0113720 | A1* | 5/2011 | Peacock et al. | 52/741.1 |
| 2012/0217101 | A1* | 8/2012 | Peacock | B66B 11/0045 187/414 |
| 2012/0291395 | A1* | 11/2012 | Plathin | 52/741.1 |
| 2013/0118838 | A1* | 5/2013 | Plathin | D07B 1/02 187/251 |
| 2014/0000987 | A1* | 1/2014 | Peacock | B66B 19/00 187/414 |

FOREIGN PATENT DOCUMENTS

| | | | | |
|---|---|---|---|---|
| EP | 2 284 113 | | 2/2011 | |
| FI | WO 2010100319 | A1 * | 9/2010 | B66B 19/00 |
| FR | 2 694 279 | | 2/1994 | |
| JP | 03264482 | A * | 11/1991 | B66B 7/00 |
| WO | WO 0007923 | A1 * | 2/2000 | B66B 19/00 |
| WO | WO 0050328 | A2 * | 8/2000 | B66B 19/00 |
| WO | WO 2004/050526 | | 6/2004 | |
| WO | WO 2011148033 | A1 * | 12/2011 | B66B 19/02 |

* cited by examiner

METHOD AND AN ELEVATOR ARRANGEMENT

This application claims priority under 35 U.S.C. §120 to European patent application number EP 12158197.9, filed Mar. 6, 2012, the entire contents of which are hereby incorporated by reference.

FIELD OF THE INVENTION

Example embodiments relate to a method in constructing an elevator, and an elevator arrangement, the elevator being suitable for transporting passengers and/or goods during construction-time thereof.

BACKGROUND

Example embodiments relate generally to extending the service zone of a construction time elevator to reach higher in the elevator hoistway. In connection with so-called jump-lifts, the bottom part of an elevator hoistway is taken into use already before the building has been completed. In this case the top part of the elevator hoistway can be constructed at the same time as an elevator moving in the bottom part of the elevator hoistway already serves people on the lower floors of the building. Generally in jump-lifts the elevator car moving in the lower parts of the elevator hoistway is supported by a movable supporting platform positioned above the car in the hoistway. Often the car is moved during construction-time use with a hoisting machine supported on this supporting platform, but alternative locations for the hoisting machine also exist. The installation work in the parts of the elevator hoistway above this supporting platform is performed from a movable platform or corresponding in the elevator hoistway, which installation work comprises, among other things, the installation of guide rails and electrification in the elevator hoistway. When the elevator hoistway under construction above the supporting platform has reached a sufficient stage of completion, the completed part of the elevator hoistway can be taken into use. In this case a jump-lift is performed, where the supporting platform is raised and mounted to a higher position in the elevator hoistway. It is preferable to have a roof structure above the supporting platform, which is separate from the movable support, which roof structure forms a protective cover against weather and falling objects. The roof structure has formed the uppermost structure in the elevator hoistway beneath which all the work in the hoistway has been done. The roof structure has been positioned high above the supporting platform so as to enable working between the supporting platform and the roof structure. When the building under construction has reached a certain height or construction otherwise has reached a certain point a new roof structure has been built above the earlier and the earlier roof structure has been dismantled. The disadvantage of this procedure has been that it necessitates simultaneous presence of several roof structures. Alternatively, it is possible to lift structures of the roof structure with a worksite crane used in the construction of the building and rebuild it in a higher position. One problem with this type of arrangement is that the worksite crane is not always available when needed. When the elevator hoistway has reached its final height, a machine room has conventionally been built at the end of the elevator hoistway and after that the final machinery of the elevator has been brought there. Taking into account the above presented, a need for an improved solution for positioning the roof structure has come up.

SUMMARY

An example embodiment is to introduce an improved method and an elevator arrangement. The object of the invention is, inter alia, to solve drawbacks of known solutions and problems discussed later in the description of the invention. It is also an example embodiment to allow the lifting of the roof structure to be independently prepared and performed without haste and without disturbing other processes taking place simultaneously. Example embodiments are presented which, inter alia, facilitate simple, safe and efficient repositioning of a roof structure. Also, example embodiments are presented, where access to the lifting equipment is good and safe working position and good ergonomics can be ensured. Also, example embodiments are presented, where the lifting of the roof structure can be prepared at least to a great extent without using electrically driven lifting devices.

The method in constructing an elevator according to the example embodiments concerns an elevator which is or has been arranged to comprise during construction time a hoistway, at least one elevator unit movable in the hoistway, including at least an elevator car, a first movable support structure in the hoistway above the elevator car for supporting said at least one elevator unit (for example with a roping connected between elevator unit(s) and the support structure), and a roof structure, which is separate from the first movable support structure and positioned in the hoistway above the first support structure. In the method at least the following steps are performed:

a) the elevator car is used for transporting passengers and/or goods, and thereafter
b) the first movable support structure is lifted higher in the hoistway, and thereafter
c) the elevator car is used again for transporting passengers and/or goods, At a suitable stage a second movable support structure is (or has been) mounted in the hoistway above the roof structure. The method further comprises a step x wherein the roof structure is lifted higher in the hoistway so as to make more room below the roof structure, the roof structure being a movable roof structure. In step x the movable roof structure is lifted in the hoistway taking support for the lift from a second movable support structure mounted in the hoistway above the roof structure. Thus, the roof structure can be moved independently of other processes of the construction of the building or the elevator components below it. Furthermore, during the lifting of the roof structure, the elevator below it may be kept in use. Thus, the lifting of the roof structure can be prepared and carried out without haste. The roof structure being movable it can be lifted in such state that it protects the elevator components below it also during lifting. For this purpose, the lifting of the roof structure is preferably performed without substantial dismantling thereof.

In a preferred example embodiment in step x, the movable roof structure is lifted with a lifting arrangement which is in the hoistway, the lifting arrangement comprising the second movable support structure mounted in a mounting position above the roof structure, and preferably also a rope or equivalent and a lifting device. The lifting device may be an electrically powered lifting device, although also alternatively powered devices may be suitable for this purpose.

In a preferred example embodiment so as to enable a following step x, a step e is performed where at least part(s) of the lifting arrangement is/are lifted manually by a person to extend to the level of said mounting position, preferably by carrying and/or by pulling part(s) up with a rope or equivalent to the level of said mounting position. Thus the lifting of the roof structure can be prepared at least to a great extent without using electrically driven lifting devices. In this way, the movable second support structure can be lifted to its first mounting position or to any later mounting position. The lifting height (of step x) is preferably at least as great as the distance between successive landings (e.g. 2.5 meters or more), but preferably greater (e.g. 5-50 meters).

In a preferred example embodiment in step e, a rope or equivalent by which the support for the lift of the movable roof structure is arranged to be taken from the second movable support structure and/or the second support structure is/are lifted to extend to the level of said mounting position manually by a person, such as by carrying or by pulling it/them up. The pulling is preferably done with a rope or equivalent. By manually lifting it/them, a single person can carry out considerable amount of preparation work of the lift without disturbing other on-going installation or construction processes. In this way the method can be kept also effective and simple as manual processes don't necessitate providing external energy, such as electricity.

In a preferred example embodiment in step e, a rope or equivalent is set to extend vertically in the hoistway, preferably by dropping it into the hoistway, preferably from an intended mounting position, and connected to part(s) of the lifting arrangement, after which said part(s) is/are lifted manually by a person, by pulling the rope or equivalent. In this way the person can perform the lifting safely and said part(s) can be lifted long distances.

In a preferred example embodiment, step x is performed plural times to stepwise make more room below the movable roof structure, and after performing step x, said step e is performed, where the second support structure is moved from an earlier mounting position above the roof structure upwards to a higher mounting position in the hoistway for a subsequent step x, after which the step x is performed again.

In a preferred example embodiment step b, preferably a step cycle comprising steps a to c, is performed once or plural times before performing step x.

In a preferred example embodiment step b, preferably a step cycle comprising steps a to c, is performed once or plural times after performing step x.

In a preferred example embodiment, the elevator comprises a third movable support structure between said first movable support structure and second movable support structure, and before step b the third support structure is lifted higher in the hoistway. In this way, the first supporting structure can climb upwards in the hoistway independently of the roof structure.

In a preferred example embodiment, the elevator comprises a movable working platform below the movable roof structure, and elevator structures are installed by working on the working platform. Preferably, the working platform is moved by taking support from the movable roof structure mounted above the working platform. In this way, several relatively light functions can be integrated in the same movable structure.

In a preferred example embodiment after step x, the hoistway is sealed water-proof with the roof structure. In this way, the components below it can be kept dry.

In a preferred example embodiment after step x, parts of the lifting arrangement are lowered to be in unity of the movable roof structure, preferably below a water-proof roof part thereof, so as to store them the time between steps x and e. In this way the lifting parts are not exposed to water and they remain in good shape also if the construction process takes a long time.

In a preferred example embodiment in step x, the movable roof structure is lifted with a lifting arrangement in the hoistway, the lifting arrangement comprising a lifting device in unity of the movable roof structure. Thus, the lifting device is easy to access.

In a preferred example embodiment, the elevator comprises a movable working platform below the movable roof structure, and the working platform is moved with a lifting device in unity of the movable roof structure, preferably positioned below a water-proof roof part thereof. Thus, multiple light-weighted functions are integrated in one movable structure. Also, the lifting device is easy to access and may be kept safe from water.

In a preferred example embodiment, the lifting device(s) positioned in unity of the movable roof structure is/are accessed via a platform below the water-proof roof part. Thus, accessing the lifting devices, safety and ergonomics are improved.

The elevator arrangement according to example embodiments comprises a hoistway, at least one elevator unit movable in the hoistway, including at least an elevator car, a first movable support structure in the hoistway above the elevator car, for supporting said at least one elevator unit, for example with a roping connected between elevator unit(s) and the support structure, and a roof structure, separate from the movable support structure, in the hoistway above the first movable support structure. The roof structure is a movable roof structure, and the arrangement comprises a lifting arrangement in the hoistway for lifting the movable roof structure higher in the hoistway, the lifting arrangement comprising a second movable support structure mounted in the hoistway above the movable roof structure, the lifting arrangement being arranged to take support from the second movable support structure for said lifting of the movable roof structure. Thus, benefits as described above can be achieved.

In a preferred example embodiment, the movable roof structure is water-proof, preferably comprising a water-proof membrane. Preferably, the movable roof structure comprises a water-proof roof part. Preferably, the movable roof structure comprises a roof part comprising an inclined water-proof upper surface. In this way, entering of water into the hoistway beneath can be efficiently avoided.

In a preferred example embodiment, the arrangement comprises stairs or ladder extending to the level of the intended mounting position. They can extend between the level of the second movable support structure and a level higher than the level of the second movable support structure. In this way, a person can easily at any time move to the level of the intended new mounting position.

In a preferred example embodiment, the movable roof structure and one or more sidewalls of the hoistway is sealed in waterproof manner.

In a preferred example embodiment, the movable roof structure covers substantially the whole vertical projection of the hoistway.

In a preferred example embodiment, the second movable support structure is portable by a person or consists of plural parts each portable by a person detachably connected to each other. The plural parts could comprise e.g. plural beams.

In a preferred example embodiment, the second movable support structure is in the form of a beam, preferably comprising wood and/or metal as main material. In this way, it is easy to move manually and it can be formed light-weighted.

In a preferred example embodiment the weight of the second movable support structure is at most 35 kg, preferably at most 25 kg, more preferably at most 20 kg in weight, or the second support structure consists of plural detachably connected parts each having a weight of 35 kg at most, preferably at most 25 kg, more preferably at most 20 kg. In this way the second movable support structure is manually movable by a person.

In a preferred example embodiment, the arrangement comprises a movable working platform below the movable roof structure. Thus, installation work can be performed during elevator use between the first support structure and the movable roof structure. Preferably, the working platform is arranged to be moved by taking support from the movable roof structure. Thus, several functions can be installed into this movable structure. Several functions can thus be accessed as well as moved upwards in the hoistway simultaneously.

In a preferred example embodiment, the elevator arrangement comprises a lifting device for lifting the roof structure and/or a lifting device for lifting a movable working platform below the movable roof structure in unity of the movable roof structure, preferably below a water-proof roof part thereof. Preferably, the elevator arrangement further comprises a power supply to the lifting device(s), the power supply being preferably electrical power supply line and the lifting device(s) being electrical lifting device(s).

In a preferred example embodiment, the lifting arrangement comprises the second support structure, a rope or equivalent, and a lifting device, the lifting device being in unity of the movable roof structure.

In a preferred example embodiment, the movable roof structure comprises a platform on which a person can walk and a water-proof roof part above the platform.

In a preferred example embodiment, the lifting device(s) positioned in unity of the that the movable roof structure is/are accessible via the platform, preferably fixed to the platform.

In a preferred example embodiment, the elevator arrangement comprises a power supply to the lifting device(s) positioned in unity of the movable roof structure, the power supply being preferably electrical power supply line and the lifting device(s) being electrical lifting device(s).

The construction-time elevator arrangement is preferably installed inside building, the car traveling vertically, preferably responding to landing calls and/or car calls. The car has preferably an interior space suitable for receiving passenger or passengers. The car is preferably arranged to serve two or more landings. These qualities are preferably present also in the final and permanently present elevator constructed with the method/elevator arrangement. The hoistway is preferably inside the building. The building is preferably a tower building.

BRIEF DESCRIPTION OF THE DRAWINGS

In the following the present invention will be described in more detail by way of example and with reference to the attached drawings, in which.

DETAILED DESCRIPTION OF EXAMPLE EMBODIMENTS

Figure 1:
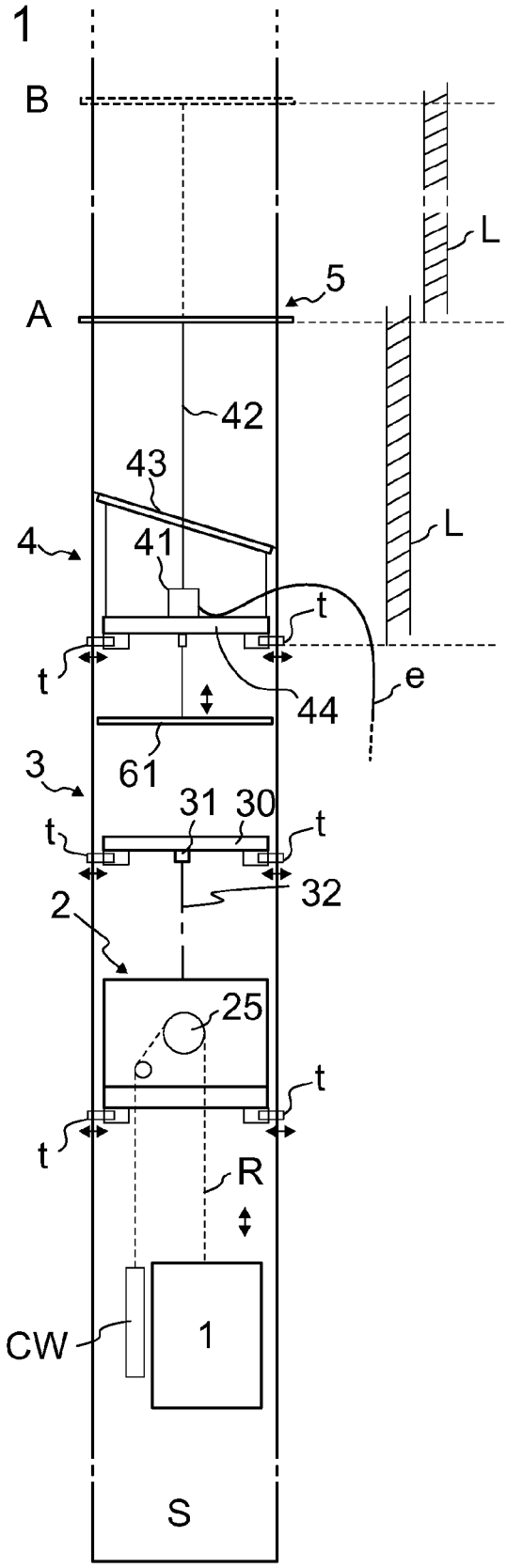
FIG. 1 illustrates an overview of the elevator arrangement according to an embodiment of the invention where method steps of the invention can be performed.

In FIG. 1, it is illustrated an example embodiment where the elevator arrangement has been arranged to comprise during construction time a hoistway S, and an elevator unit 1 movable in the hoistway S, the elevator unit being an elevator car 1 for transporting passengers and/or goods. The elevator arrangement may also comprise additionally other movable elevator units such as the counterweight CW, as depicted. The elevator arrangement further comprises a first movable support structure 2 in the hoistway above the elevator car 1, for supporting said at least one elevator unit (1,CW), in this case with a roping R connected between elevator unit(s) and the support structure 2. The elevator arrangement further comprises a roof structure 4, separate from the movable support structure 2, in the hoistway S above the support structure 2, and a lifting arrangement (41,42,5) in the hoistway S for lifting the movable roof structure 4 higher in the hoistway S. The roof structure 4 is a movable roof structure, and the lifting arrangement (41, 42,5) comprises a second movable support structure 5 mounted in the hoistway S above the movable roof structure 4, the lifting arrangement (41,42,5) being arranged to take support from the second movable support structure 5 for said lifting of the movable roof structure 4. Roof structure 4 can be lifted upwards separately from the movable support structure 2 so as to make room between them. In the method the elevator car 1 is used for transporting passengers and/or goods (step a). The top part of the elevator hoistway S above the support structure 2 can be constructed at the same time as an elevator car moving in the bottom part of the elevator hoistway already serves people on the lower floors of the building. When the elevator hoistway under construction above the movable support structure 2 has reached a sufficient stage of completion; the completed part of the elevator hoistway S can be taken into use. In this case elevator car is taken out of said use and a jump-lift is performed, wherein the movable support structure 2 is lifted (step b) and mounted to a higher position in the elevator hoistway. After this the elevator car 1 is taken back to said use for transporting passengers and/or goods. FIG. 1 also show a third support structure 3 between the roof structure 4 and the supports structure 2 wherefrom support is taken for the lift of the first support structure 2 in step b. The lifting of the first support structure 2 can be performed with a lifting device 31 pulling the first support structure 2 with a rope system 32 up. The lifting device may be in unity of the first or third support structure. However, the lifting of the support structure 2 need not be carried in this particular fashion as alternative arrangements exist. Before step b the third support structure 3 can be lifted higher in the hoistway taking support from the roof structure 4. For this purpose the movable roof structure 4 may comprise a lifting device 61 connected/connectable via a rope system 62 to the third support structure 3. FIG. 1 also shows a movable working platform 61 below the movable roof structure 4, wherefrom elevator structures are installed by working on the working platform during said use of car 1. The working platform is moved by taking support from the movable roof structure 4 mounted above the working platform 61. For enabling the lifting of the third movable support structure 3 the movable working platform 61 may be connected to the third movable support structure 3 for the time of the lifting. The lifting device 61 need not be positioned in unity of the movable roof structure, but instead it could be positioned in unity of the working platform 61.

Figure 2:
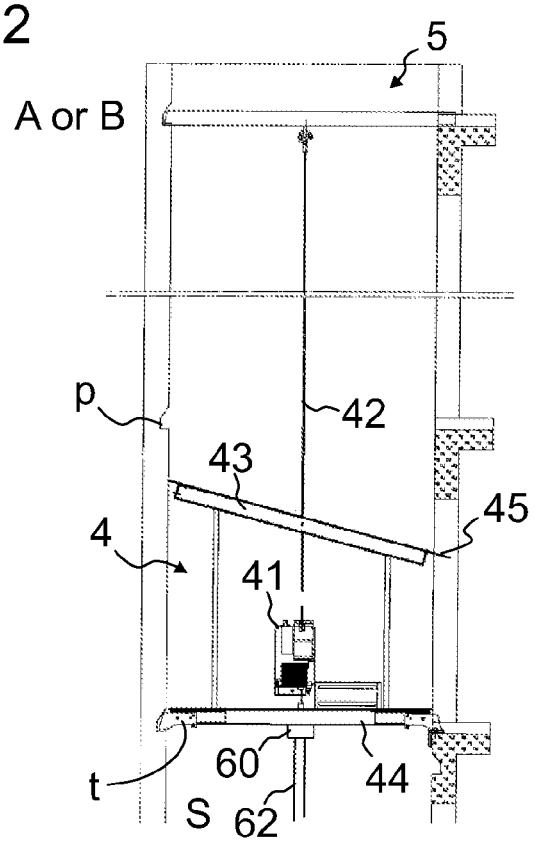
FIG. 2 illustrates the elevator arrangement before step x.
Figure 3:
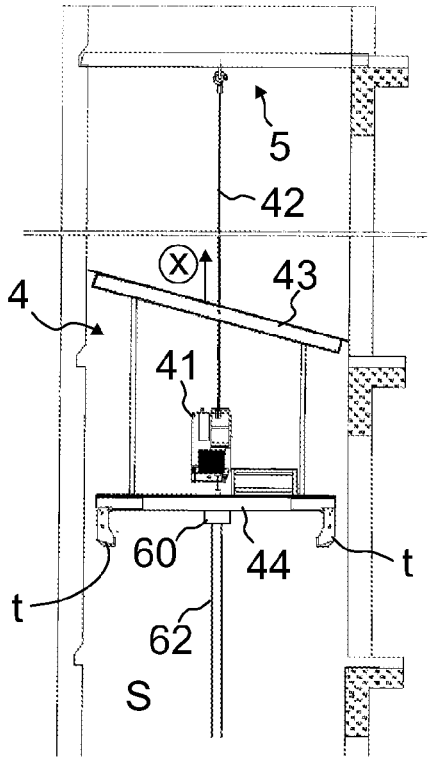
FIG. 3 illustrates the elevator arrangement when step x is being performed.

When a suitable number of jump-lifts has been performed (cycles of steps a to c), for example the support structure 2 has become close to said roof structure 4, the movable roof structure 4 is lifted (step x) higher in the hoistway S so as to make more room below it. For this purpose the roof structure 4 is made to be a movable roof structure, having supporting means t transferrable to a state where they don't block vertical movement of the movable roof structure 4, such as laterally extendable support elements. FIG. 2 illustrates a preferred arrangement before step x and FIG. 3 illustrates step x. In step x the movable roof structure 4 is lifted in the hoistway S taking support for the lift from a second movable support structure 5 mounted in the hoistway S above the roof structure 4. As illustrated, means t have been transferred to unblocking state prior to the lifting of the movable roof structure 4. Step x is done when support structure 2 has been raised so close to roof structure 4 that more room is needed between them. Another reason for lifting the movable roof structure 4 could be that installation work of elevator components needs to be continued above the current level of the roof structure 4. The lifting of the movable roof structure 4 is arranged to be done without substantial dismantling of the roof structure 4, which is can be enabled by means t, which are also described elsewhere.

Figure 4:
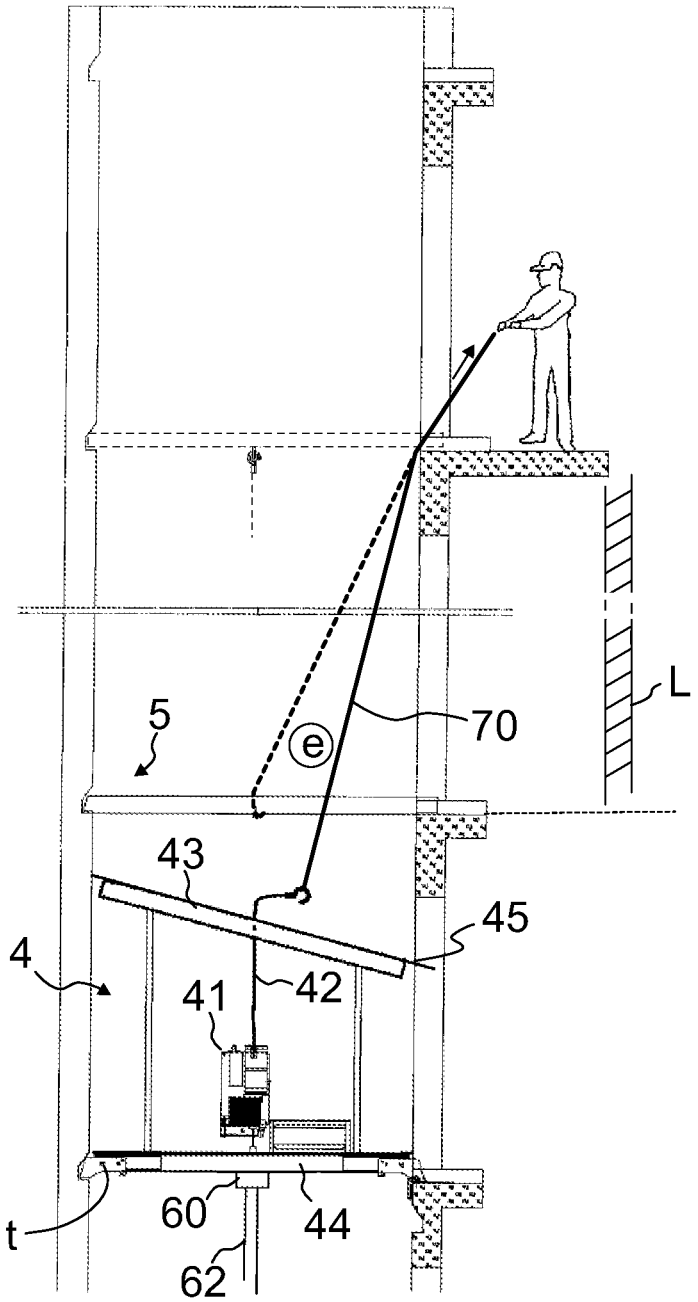
FIG. 4 illustrates the elevator arrangement when step e is being performed.

In step x the movable roof structure 4 is lifted with a lifting arrangement (41,42,5) which is in the hoistway S. The lifting arrangement (41,42,5) comprises the second movable support structure 5, and preferably also a rope 42, and a lifting device 41. Alternatively, other lifting means could be used instead of rope 42 and device 41. For enabling a subsequent step x the second movable support structure 5 is mounted in the hoistway S in a mounting position (A or B) above the movable roof structure 4 as illustrated in FIG. 1. This mounting can be done at a suitable moment before step x. In FIG. 1 mounting position A illustrates a mounting position where the second movable support structure 5 is to be mounted to perform step x possibly for the first time. Mounting position B illustrates a mounting position where the second movable support structure 5 is to be mounted after already performing step x, thus being higher than mounting position A. In both cases the lifting arrangement can be made to extend to the level of mounting position (A or B) for a subsequent step x by lifting the second movable support structure 5 to the level of its mounting position (A or B) from its earlier position. This can be done by performing step e as described elsewhere in the application, for instance. Step x can be performed once, or alternatively plural times to stepwise make more room below the roof structure 4. In case of plural steps x, after performing a preceding step x, the lifting arrangement is lifted to extend to the level of mounting position B for a subsequent step x. This is done preferably by step e where the second movable support structure 5 is moved from its earlier mounting position A upwards to a higher mounting position B in the hoistway S. Step e is illustrated in FIG. 4. After performing step e step x is performed.

In step e the lifting arrangement (41,42,5) is lifted to extend to the level of mounting position (A or B) for a subsequent step x. Said level of the mounting position (A,B) is above the level of the movable roof structure 4. This lifting is preferably done at least partially manually by a person, preferably by carrying or by pulling up with a rope or equivalent 70. Thus, no complicated lifting system is needed to move the point of support higher in the hoistway S. The person can climb ladders or stairs L up to the level of the intended mounting position A or B of the second movable support structure 5. He can carry the second movable support structure 5 up to this level (in one piece or in several) and mount it into position for lifting. To lift the rope 42 of the lifting arrangement to extend to the level of the higher mounting position the person preferably drops a pulling rope or equivalent 70 down to the movable roof structure 4 and subsequently it is connected to the rope or equivalent 42 of the lifting arrangement and the rope or equivalent 42 is pulled up with the rope or equivalent 70, as illustrated in FIG. 4. After this, the rope or equivalent 42 is connected to the second movable support structure 5 and the arrangement is ready for lifting. Alternatively, instead of carrying, the person can pull also the second movable support structure 5 up to the level of the higher mounting position B with the rope or equivalent 70 as illustrated with broken line in FIG. 4. It may be that the second movable support structure 5 is difficult to pull up in the hoistway. Then it is preferable that the lifting of step e is done by pulling the rope or equivalent 42 up with the rope or equivalent 70 and by carrying the second movable support structure 5 up to the level of the intended mounting position A or B of the second movable support structure 5, as described above.

It is preferable, that after each step x the hoistway is sealed water-proof with the roof structure 4, e.g. by extending a water-proof membrane to extend up to the surface of the hoistway S. After the lifting of the movable roof structure 4, a step cycle comprising steps a to c can be performed once or plural times as there is now more room between them. After said cycle/cycles, steps e and x can be performed again. By performing the sequence of steps (n times (a+b+c)+e+x) suitable number of times, the structures 2 and 4 can be lifted as high in the hoistway as needed.

Figure 5:
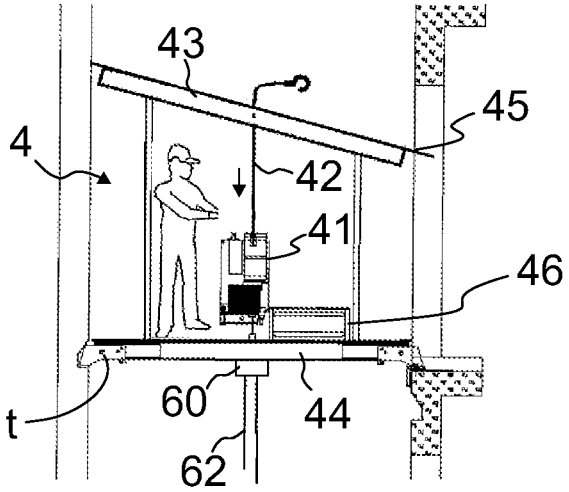
FIG. 5 illustrates the elevator arrangement when step x' is being performed.

FIG. 5 illustrates a preferred additional step x' performed after step x and before next step e. In step x' parts of the lifting arrangement 41, 42, 5 are lowered to be in unity of the movable roof structure 4 so as to store them the time between steps x and e. For this purpose, the lifting rope or equivalent 42 of the lifting arrangement is lowered to the unity of the roof structure 4, preferably below the water-proof roof part 43 thereof. Also the second support structure 5 is preferable to be positioned in this way below the water-proof part 43. Thus, they are stored safe from falling objects and water. Also, they are not in the way of not elevator related construction work taking place above the water-proof roof part 43. There may be a hole in the water-proof part 43 for the rope or equivalent 42, which hole can be sealed after the rope or equivalent is lowered below it. The rope 42 is preferably reeled on a reel 46 positioned below the water-proof part 43. After step x (particularly after step x' if this step is chosen to be performed), the hoistway is sealed water-proof with the roof structure 4, e.g. by extending a water-proof membrane to extend up to the surface of the hoistway S. When it is needed to perform step e again, then the second movable support structure 5 is mounted in the hoistway S above the roof structure 4 and rope 42 is connected to it as depicted in FIG. 4 for enabling next lift of the movable roof structure 4.

The initial lifting of the movable second supporting structure 5 to its mounting position A and lifting from mounting position A to the even higher mounting position B can be performed by step e substantially in corresponding ways (as described in context of FIG. 4). Also in case an earlier step x' has been performed, step e may be performed substantially in a corresponding way. The only difference may be in specific position of parts of lifting arrangement before step e. In all these cases said parts are before step e at a level lower than the intended mounting position (A or B) of the second movable support structure 5, the intended mounting position (A or B) being above the movable roof structure 4.

As mentioned, the second support structure 5 is movable. This means that it is demountably supportable in different vertical positions in the hoistway S. It can be made to be in form of a beam resting (e.g. resting freely or in releasably fixed manner) on top of stationary supporting structures of the elevator, such as upper surfaces of structures of the hoistway and a sill of the landing door opening. The roof structure 4 is movable, as well. This means that it is demountably supportable in different vertical positions in the hoistway. For this purpose, the construction-time elevator (the roof structure 4) has preferably been arranged to comprise supporting means t for supporting the roof structure 4 stationary in the elevator hoistway S, which means t are transferrable between state I where the roof structure 4 is supported stationary and state II where the roof structure 4 is not supported stationary. When in state II, the supporting means t do not block upwards directed vertical movement of the roof structure in the hoistway S. The first support structure 2 and/or the third support structure 3 are preferably made movable in corresponding manner as the movable roof structure 4.

The supporting means t preferably comprise laterally extendable support elements (for example as depicted in drawings). When in supporting state I, each support element may extend on top of a stationary supporting structure of the elevator, such as an upper surface of an elevator hoistway structure or a sill of the landing door opening. For this purpose, the hoistway S may be designed to have at intervals supporting structures. For instance, pockets p can be made in the hoistway walls. The support elements can be formed to be laterally extendable (and retractable back to non-extended state) by linear movement or by pivoting. The support elements are preferably lockable into extended and/or contracted state. In FIG. 1, the support elements are movable between said positions by linear, movement and in FIGS. 2-4 by pivoting movement. The supporting means t could have alternatively have a different design. A preferred alternative design would be such that the means t are gripping means arranged to grip elevator guide rails when in state I and not grip when in state II. Such gripping means would preferably be in the form of a wedging-type gripper, having a wedging-part arranged to wedge between guide rail and an upwardly tapering housing surface of the gripper if the gripping means moves downwards, thus utilizing a structure well known from elevator safety gear-devices.

The roof structure 4 is preferably water-proof. Thus, is stops water from entering the hoistway below it. Furthermore, the roof structure 4 and one or more sidewalls of the hoistway S is preferably sealed in waterproof manner. Preferably, it comprises a water-proof roof part 43, and a platform 44 below the water-proof roof part 43. For making the roof structure 4 water-proof, it preferably comprises a water-proof membrane 45 as part of the roof part 43. To facilitate water running away from the hoistway S, the movable roof structure 4 comprises an water-proof part 43 forming an inclined water-proof surface.

As mentioned, the second movable support structure 5 is preferably portable by a person or consists of plural portable (by a person) parts detachably connected. Thus, it can be carried or pulled by person (in one piece or several) to the level A or B which is the new mounting position thereof from a lower level. The second movable support structure 5 is preferably in the form of a beam. Thus it is simple and can be made rigid and reliable with low weight. A light but rigid beam structure 5 can be made from wood and/or metal. The weight of the second movable support structure is at most 35 kg, preferably at most 25 kg, more preferably at most 20 kg in weight or the second support structure consists of plural detachably connected parts each having a weight of 35 kg at most, preferably at most 25 kg, more preferably at most 20 kg.

The movable roof structure is preferably such that a lifting device 41 for lifting the roof structure 4 is in unity of the movable roof structure 4. Furthermore, the roof structure 4 may also comprise a lifting device 60 for lifting a working platform 61 below roof structure 4 (preferably with roping 62). The movable roof structure 4 preferably also comprises a power supply f to the lifting device(s) 41 and/or 60, the power supply being preferably electrical power supply line and the lifting device 41/60 being an electrical lifting device. Thus the lifting device(s) 41/60 can be accessed for used or maintenance easily. Also, power feed is in this way simple and preferably provides power for multiple devices with only one line. The lifting device(s) 41,60 is/are preferably accessible via the platform and preferably fixed to the platform 44. The lifting device 41 and/or the lifting device 60 is/are preferably remotely controllable, e.g. via a control cable or a wireless connection.

Parts 42, 62 and 70 are preferably ropes, such as metal ropes, but an equivalent flexible member could be used, such as a belt or chain. Correspondingly, roping R could be formed of ropes or equivalent components. With term portable structure it is meant structure that can be lifted manually by a person, particularly pulled up or carried by a person. In the embodiments described, the end of the rope 42 is connected to the structure 5 such that hoisting ratio is 1:1. However, this is not necessary as alternatively the rope 42 could be connected to the structure 5 by a pulley(s) such that 2:1 hoisting ratio is achieved or more pulleys such that even higher ratio is achieved. It is to be understood that the above description and the accompanying figures are only intended to illustrate the present invention. It will be obvious to a person skilled in the art that the inventive concept can be implemented in various ways. The invention and its embodiments are not limited to the examples described above but may vary within the scope of the claims.

The invention claimed is:

1. A method in constructing an elevator, in which the elevator includes at least one elevator car movable in a hoistway, a first movable support structure, a separately movable roof structure, and a lifting arrangement, the first movable support structure being separate from the at least one elevator car, in the hoistway above the at least one elevator car, the first movable support structure being configured to support said at least one elevator car, the separately movable roof structure being, separate from the first movable support structure, in the hoistway above the first movable support structure, and the lifting arrangement including a second movable support structure mounted in the hoistway at a first mounting position above the separately movable roof structure, the method comprising:

providing the at least one elevator car to be used for transporting passengers and/or goods;

lifting the first movable support structure in the hoistway;

lifting the separately movable roof structure higher in the hoistway to create greater space between the separately movable roof structure and the first movable support structure; and manually moving the lifting arrangement by manually moving the second movable support structure upwardly in the hoistway to a second mounting position above the first mounting position while the separately movable roof structure is supported by walls of the hoistway.

2. The method according to claim 1, wherein the lifting arrangement includes a rope and a lifting device.

3. The method according to claim 2, wherein the manually moving the lifting arrangement further comprises:

manually lifting the lifting arrangement in parts by first manually moving the second movable support structure to the second mounting position by a person, and subsequently lifting the lifting the lifting device by attaching the rope of the lifting arrangement to a pulling rope and pulling the pulling rope from the second mounting position.

4. The method according to claim 3, wherein the pulling rope is set to extend vertically in the hoistway, by dropping the pulling rope into the hoistway from the second mounting position, so as to connect the parts of the lifting arrangement.

5. The method according to claim 1, wherein the elevator includes a third movable support structure between said first movable support structure and said second movable support structure, and the third movable support structure is lifted higher in the hoistway before lifting the first movable support structure higher in the hoistway.

6. The method according to claim 1, further comprising:

lowering the lifting arrangement to a platform of the separately movable roof structure prior to lifting the separately movable roof structure.

7. An elevator arrangement, comprising:

at least one elevator car movable in a hoistway;

a first movable support structure, separate from the at least one elevator car, in the hoistway above the at least one elevator car, for supporting the at least one elevator car;

a separately movable roof structure, separate from the first movable support structure, in the hoistway above the first movable support structure; and a second movable support structure mounted in the hoistway at a first mounting position above the separately movable roof structure for lifting the separately movable roof structure higher in the hoistway, the second movable support structure being manually movable upwardly in the hoistway to a second mounting position above the first mounting position while the separately movable roof structure is supported by walls of the hoistway.

8. The elevator arrangement according to claim 7, wherein the second movable support structure is movable by a person.

9. The elevator arrangement according to claim 8, wherein the second movable support structure is made up of plural parts.

10. The elevator arrangement according to claim 7, wherein a lifting arrangement is configured to lift the separately movable roof structure in the hoistway, the lifting arrangement including a rope and a lifting device, the lifting device being configured to connect to the separately movable roof structure.

11. The elevator arrangement according to claim 10, further comprising:

a power supply to lift the lifting device positioned as part of the separately movable roof structure, the power supply being an electrical power supply line and the lifting device being an electrical lifting device.

12. The elevator arrangement according to claim 7, wherein the separately movable roof structure includes a water-proof membrane.

13. The elevator arrangement according to claim 7, wherein the separately movable roof structure includes a platform on which a person can walk and a water-proof roof part above the platform.

14. An elevator arrangement, comprising at least one elevator car movable in a hoistway;

a first movable support structure, separate from the at least one elevator car, in the hoistway above the at least one elevator car, for supporting the at least one elevator car;

a separately movable roof structure, separate from the first movable support structure, in the hoistway above the first movable support structure; and a second movable support structure mounted in the hoistway above the separately movable roof structure for lifting the separately movable roof structure higher in the hoistway, wherein the second movable support structure is movable by a person.

* * * * *